US005984411A

United States Patent [19]

Galumbeck

[11] Patent Number: 5,984,411

[45] **Date of Patent: *Nov. 16, 1999**

[54] ELEVATOR CHAIR

[76] Inventor: Michael H. Galumbeck, 5577 Vantage Point Rd., Columbia, Md. 21044

[ * ] Notice: This patent issued on a continued prosecution application filed under 37 CFR 1.53(d), and is subject to the twenty year patent term provisions of 35 U.S.C. 154(a)(2).

[21] Appl. No.: 08/708,858

[22] Filed: Sep. 9, 1996

Related U.S. Application Data

[60] Provisional application No. 60/003,548, Sep. 11, 1995.

[51] Int. Cl.[6] ..... A47C 1/02

[52] U.S. Cl. ..... 297/344.15; 297/344.17; 297/330; 297/DIG. 10

[58] Field of Search ..... 297/344.15, 344.14, 297/344.17, 329, 330, 334, 340, DIG. 10

[56] References Cited

U.S. PATENT DOCUMENTS

| | | | |
|---|---|---|---|
| 3,138,402 | 6/1964 | Heyl, Jr. et al. | 297/344.17 X |
| 4,231,614 | 11/1980 | Shaffer . | |
| 4,249,774 | 2/1981 | Andreasson . | |
| 4,598,944 | 7/1986 | Meyer et al. . | |
| 4,809,804 | 3/1989 | Houston et al. | 297/330 X |
| 5,031,251 | 7/1991 | Williams et al. | 297/330 X |
| 5,096,008 | 3/1992 | Mankoswski | 297/DIG. 10 X |
| 5,211,414 | 5/1993 | Galumbeck . | |
| 5,316,370 | 5/1994 | Newman | 297/DIG. 10 X |
| 5,363,934 | 11/1994 | Edmund et al. | 297/DIG. 10 X |
| 5,401,044 | 3/1995 | Galumbeck . | |
| 5,513,867 | 5/1996 | Bloswick et al. . | |

FOREIGN PATENT DOCUMENTS

| | | | |
|---|---|---|---|
| 2492657 | 4/1982 | France . | |
| 251508 | 5/1983 | France | 297/DIG. 10 |
| 2161371 | 1/1986 | United Kingdom | 297/DIG. 10 |
| WO 8201314 | 4/1982 | WIPO . | |
| 2014432 | 9/1992 | WIPO | 297/DIG. 10 |

*Primary Examiner*—Laurie K. Cranmer
*Attorney, Agent, or Firm*—Harness, Dickey & Pierce, P.L.C.

[57] ABSTRACT

The elevator chair has a seat assembly mounted on a support frame which includes an occupant supporting seat having a rear seat section, a seat back connected to and extending upwardly from the rear seat section and a front seat section which extends substantially across the extent of the rear seat section and which is pivoted to the rear seat section. A seat drive unit drives the seat assembly from a first position where the front and rear seat sections extend in the same first plane to a second position where the rear seat section remains in a second plane parallel to said first plane while the front seat section angles downwardly and outwardly. Subsequently the seat drive unit drives the seat assembly to a third position where the rear seat section tilts forwardly toward the front seat section.

41 Claims, 4 Drawing Sheets

ELEVATOR CHAIR

This application is a continuation in part application of provisional application No. 60/003,548 filed Sep. 11, 1995.

BACKGROUND OF THE INVENTION

It is often desirable to provide assistance to a person who is attempting to move from a sitting position in a chair to a standing position. Age, infirmity, or various disabilities often render it difficult for persons to rise out of a chair from a sitting to a standing position without assistance.

In moving the occupant of a chair from a sitting to a free standing position, it is critical that both positions provide adequate and comfortable support if the chair is to function efficiently. The chair should be designed to distribute pressure to the back, buttocks and thighs of a user in the standing position. Also, as the chair moves an occupant from a sitting to a standing position, it is often critical that the chair backrest not apply shear stresses to the back of an occupant. It is very important that the upper leg of the occupant be positioned as the chair rises to support the weight of the occupant in the standing position as weight is transferred from the chair to the legs. Once the legs are properly positioned, then it is desirable for the chair to tilt forward to aid in transferring the weight of the occupant to the occupant's legs.

In the past, the design of chairs which have been developed to move occupants upwardly from a sitting position has been directed toward providing the upward movement and has not concentrated on positioning the legs and torso of the occupant and then tilting the chair for transition from the sitting to the standing position. U.S. Pat. No. 4,249,774 to Andreasson discloses a chair of this type which requires an occupant to slide forward over a projecting seat.

A number of wheelchairs have been developed to raise an occupant from a sitting to a standing position and to support the occupant in the standing position, but these chairs are designed for continued occupant support in a standing position and not to facilitate transition from the chair to a free standing, unsupported position. U.S. Pat. Nos. 5,211,414 and 5,401,044 to Galumbeck are illustrative of wheelchairs of this type.

SUMMARY OF THE INVENTION

It is a primary object of the present invention to provide a chair having a drive mechanism which can be controlled by an occupant to change the position of the occupant from sitting to a free standing position.

Another object of the present invention is to provide a chair which moves its user from a sitting position to a comfortable, supported standing position which will enable a user to safely enter and leave the chair.

It is yet another object of the present invention to provide a chair which includes a seat that is driven between two vertical positions above a lowermost seated position by a seat drive mechanism. In the intermediate position, the seat is configured to provide both user support and comfort while positioning the upper legs of the user to receive the user's weight, while in the uppermost position, the seat tilts forward to transfer the user's weight.

It is a still further object of the present invention to provide a chair having a drive mechanism which drives the chair upwardly from a first to a second position. As the chair moves upwardly, the back and seat remain in the position they assumed when the occupant was sitting, and a front section of the seat in contact with an occupant's legs between the hip and knee angles downwardly to position the legs to receive an occupant's weight. Once the occupant's legs are positioned, the back and seat tilt forward to transfer the occupant's weight from the chair to the legs.

DESCRIPTION OF THE PREFERRED EMBODIMENTS

Figure 1:
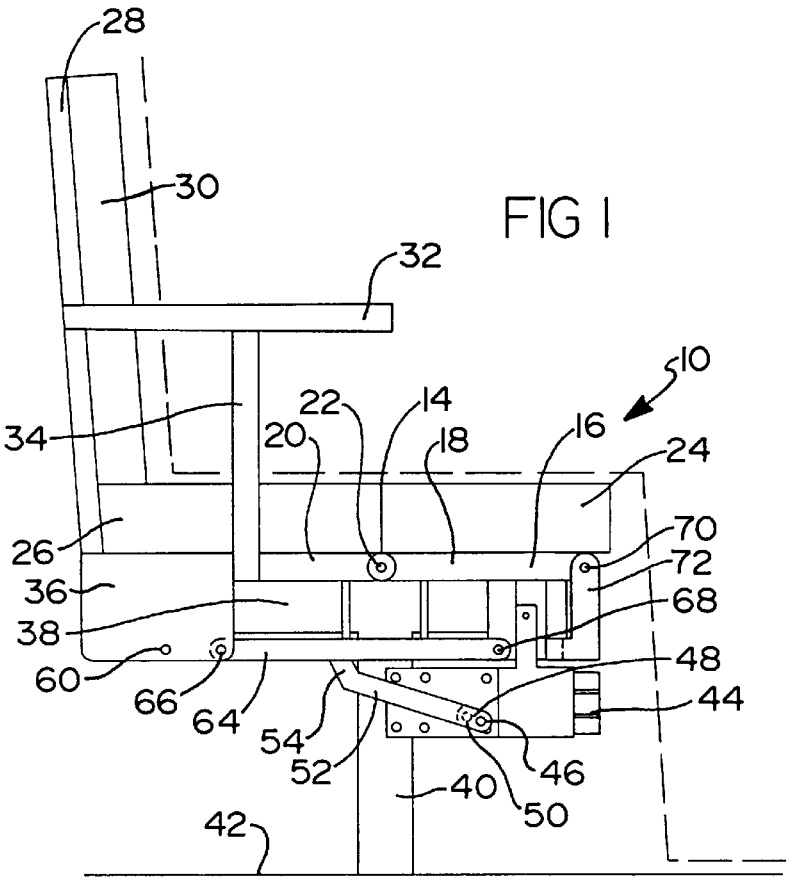
FIG. 1 is a view in right side elevation of the elevator chair of the present invention.

Referring to the drawings, the elevator chair of the present invention indicated generally at 10 includes a seat assembly 14 having a cushion supporting frame 16 which is formed into a front section 18 and a rear section 20 which are preferably equal in size. The rear seat section may however be equal in size or wider from front to rear than the front seat section 18 to comfortably support an occupant in a sitting position without the support provided by the front seat section. The front section of the cushion supporting frame 16 is pivotally secured to the rear section by a hinge 22 which extends transversely across the frame. The front and rear sections 18 and 20 of the cushion supporting frame are substantially rectangular sections with crossbars or a bottom wall to support a front section cushion 24 and a rear section cushion 26 which are mounted on the front and rear sections respectively.

Secured to the rear section 20 of the cushion supporting frame at the free end opposite to the hinge 22 is a back rest frame 28 which again is a substantially rectangular frame having frame cross beams to support a back cushion 30. An armrest 32 secured to the back rest frame projects outwardly therefrom on either side of the back cushion 30, and is supported by a support post 34 secured to the rear section 20 of the cushion supporting frame. Projecting downwardly from the rear section of the cushion supporting frame beneath the back rest frame is a linkage supporting bracket 36.

Figure 2:
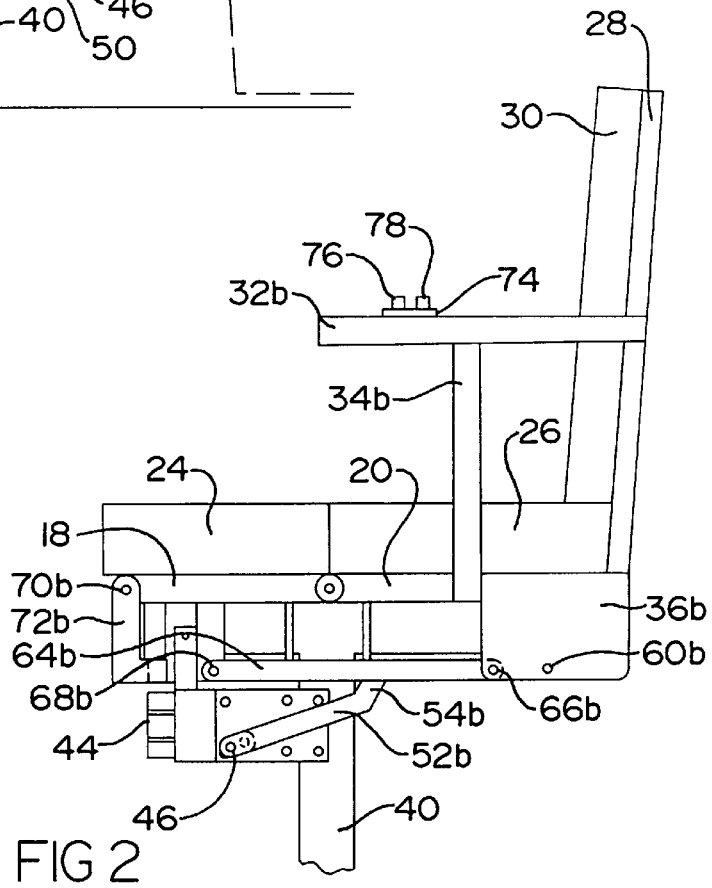
FIG. 2 is a view in left side elevation of the elevator chair of the present invention.

When the seat assembly is in the lowermost position as shown in FIGS. 1 and 2, the cushion supporting frame 16 rests upon a rectangularly shaped support member 38 which is mounted inwardly from the linkage supporting bracket 36. The support member 38 may be secured to a vertical support post 40 which extends upwardly from a horizontal support surface 42. This horizontal support surface could, for example, be a support surface attached to the frame of a motorized scooter for propelling an occupant, and in this case, a handle bar control for the scooter will project upwardly in front of the elevator chair 10. Alternatively, the support surface 42 could be a pedestal for resting on a floor or other horizontal surfaces, and in some instances, the pedestal 40 is only one of a number of supporting legs attached to the rectangular support member 38.

An electrically powered fractional gear motor 44 is mounted upon the rectangular support member 38 and includes a motor drive shaft 46 which extends outwardly from opposite sides of the gear motor. The drive shaft 46 is connected to rotate a short link 48 which is pivoted at 50 to a drive link 52. The end of the drive link 52 remote from the pivot 50 is angled upwardly at 54 at an angle of approximately 45° to the remainder of the drive link and is pivotally connected at 56 to a point substantially at the center of a first pivoted link 58. The pivoted link 58 is a straight, elongate link having a first end pivotally connected at 60 to the linkage supporting bracket 36 and a second end pivotally secured at 62 to the rectangular support member 38. The first pivoted link 58 is positioned behind and slightly inwardly of a second straight, elongate pivoted link 64 of substantially the same length. An upper end of the second pivoted link is connected to the linkage supporting bracket 36 by a pivot 66 and the remaining end of the second pivoted link is connected to the rectangular support member by a pivot 68. The pivots 66 and 68 are positioned in line with but forwardly and spaced from the pivots 60 and 62 so that the first pivoted link and second pivoted link are always substantially parallel. When the elevator chair 10 is in the downward seating position shown in FIGS. 1 and 2, the second pivoted link 64 overlies the first pivoted link 58.

The linkage construction on opposite sides of the elevator chair 10 is identical, and consequently in FIG. 2, like components to those shown in FIG. 1 are designated by the same reference numeral in combination with the designation "b".

The front section 18 of the cushion supporting frame 16 is pivoted at 70 to a bracket 72 that is secured to the front of the rectangular support member 38. It will be noted in FIGS. 1 and 2 that the front section 18 and rear section 20 of the cushion supporting frame are substantially equal in size, and, as shown by the broken lines in FIG. 1, the rear section is positioned substantially under the hips of an occupant while the front section extends outwardly under the occupant to a point spaced rearwardly of the occupant's knees.

Figure 3:
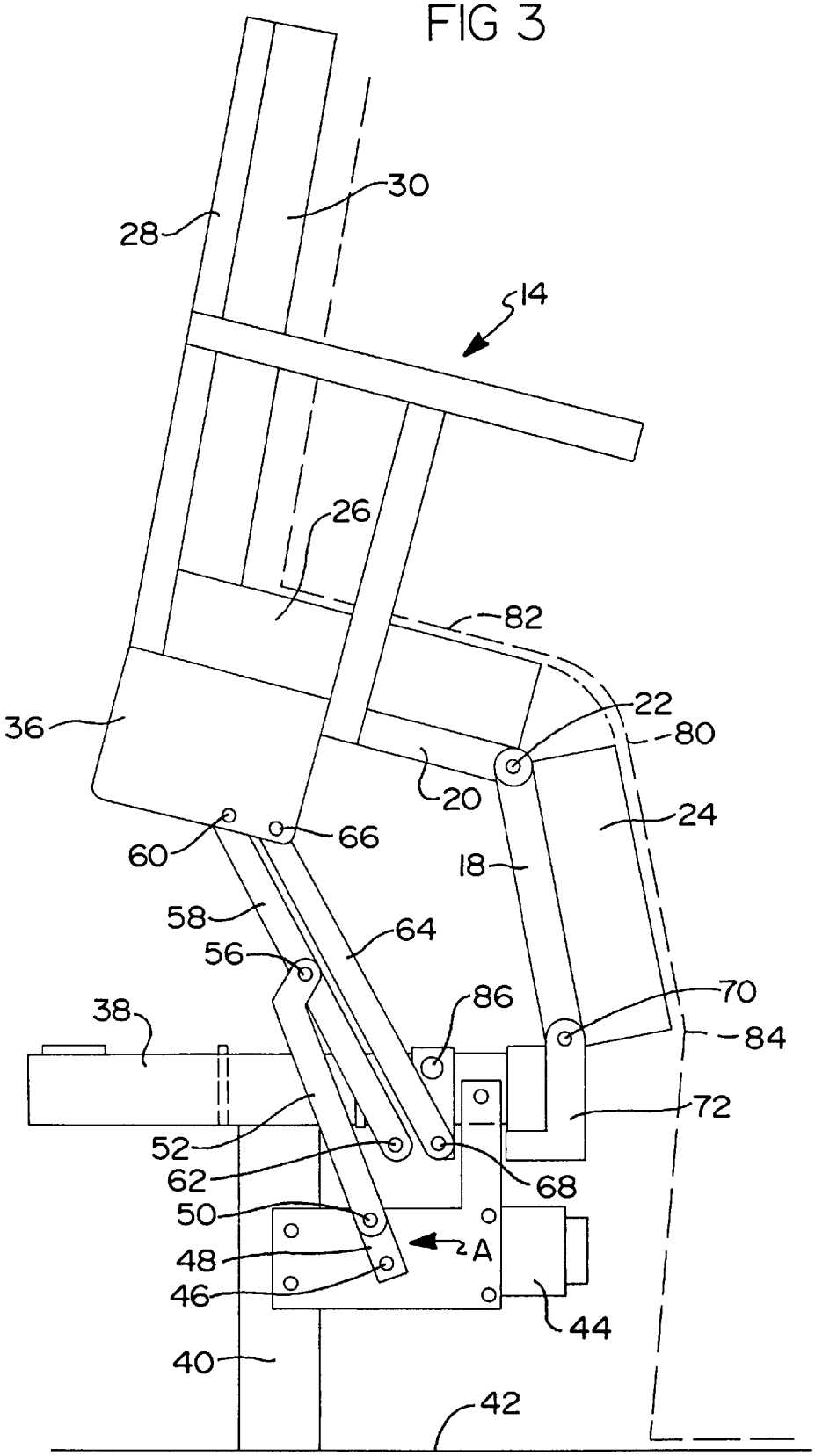
FIG. 3 is a view in side elevation of the elevator chair of the present invention in the uppermost position thereof.

To raise the elevator chair from the lowermost sitting position shown in FIGS. 1 and 2 to a second raised position and then to the uppermost standing position shown in FIG. 3, a motor control panel 74 is provided on one of the arms of the elevator chair. The motor control panel includes a first switch 76 which operates the fractional gear motor to drive the motor drive shaft 46 in FIG. 1 in a clockwise direction to raise the seat assembly 14 and a second switch 78 which reverses the fractional gear motor 44 to drive the drive shaft 46 in a counterclockwise direction in FIG. 1 to lower the chair from the position of FIG. 3 to that of FIGS. 1 and 2. The motor control panel 74 is connected in known manner between a power supply (not shown) and the fractional gear motor.

Figure 6:
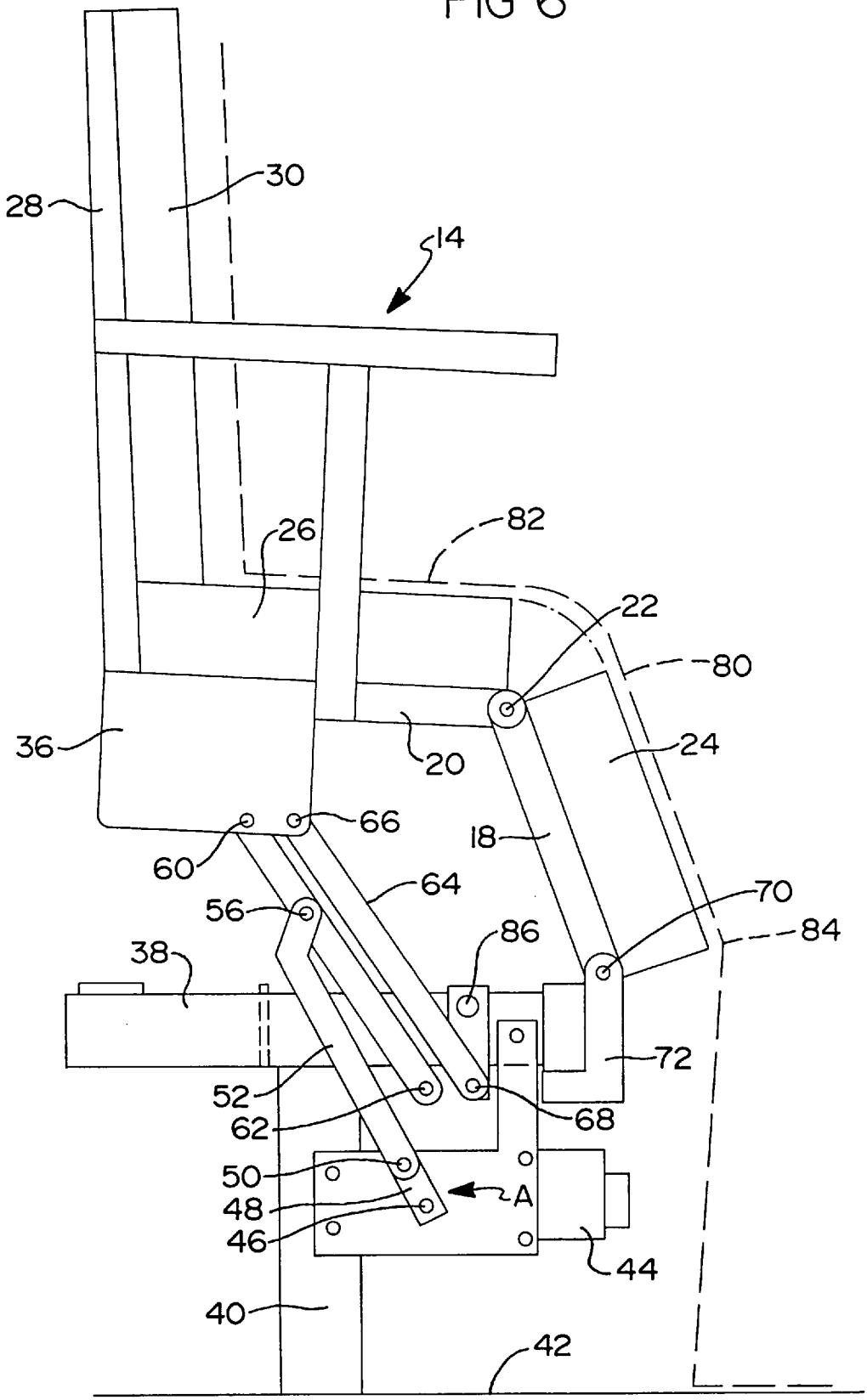
FIG. 6 is a view in side elevation of the elevator chair of FIG. 3 in a second raised position.

As will be noted from FIG. 3, when the fractional gear motor is activated to raise the seat assembly 14 from a first position of FIGS. 1 and 2 to a second position and then to its uppermost position, the front seat section 18 is drawn downwardly about the hinge 22 by the bracket 72 while the rear seat section and the seat back remain substantially in the sitting position of FIGS. 1 and 2 as shown by FIG. 6. The front seat section and the front section cushion 24 angle outwardly from the hinge 22 to raise the upper leg 80 of an occupant from a seating position to a position where the upper leg is slightly bent between the hip 82 and the knee 84. The first and second pivoted links 58 and 64 are dimensioned in length to drive the rear seat section 20 and the rear section cushion 26 further upwardly from the second position to an extent where the rear seat section and rear seat cushion angle downwardly toward the hinge 22. The rear seat section is drawn downwardly by the hinge 22 and the front seat section as the links 58 and 64 force the rear of the seat upwardly. As can be seen from FIG. 3, the rear seat cushion 46 supports the buttocks and hip area of a user but now angles them so that the user may slide forward out of the seat assembly. It will be apparent that as the user moves forward, the upper leg section 80 has been positioned to receive the user's weight, and furthermore, it is important to note that the user's hip section and back are still retained substantially perpendicular as they are in a sitting position, so that the user is not driven forward as the seat assembly rises from the first to the second position. If desired, a stop 86 may be provided on the rectangular frame 38 to engage the second pivoted link 64 and stop the seat assembly in the desired uppermost position.

It will be noted that the short link 48, which was behind the drive link 52 with the seat assembly in the lowermost position of FIGS. 1 and 2 is extended by rotation of the drive shaft 46 in the uppermost position of the seat assembly in FIG. 3.

Figure 4:
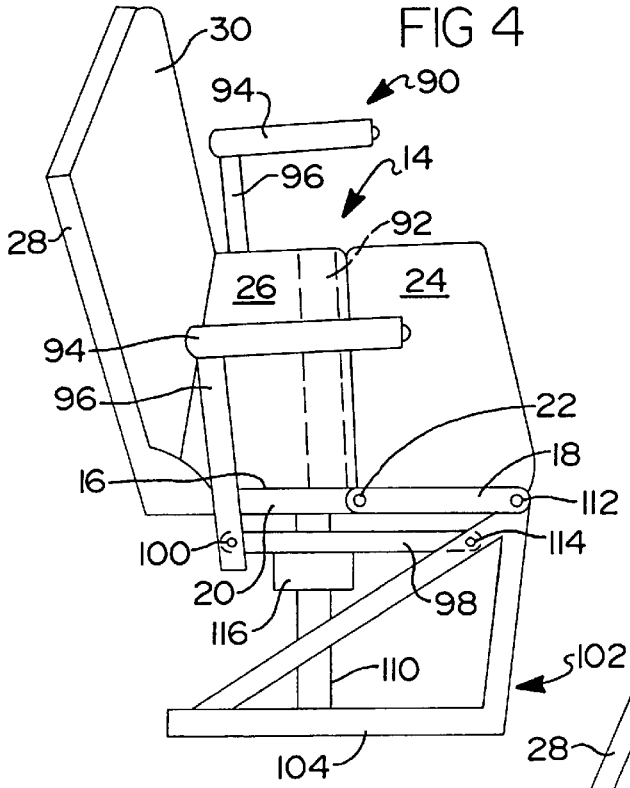
FIG. 4 is a perspective view of a second embodiment of the elevator chair of the present invention.
Figure 5:
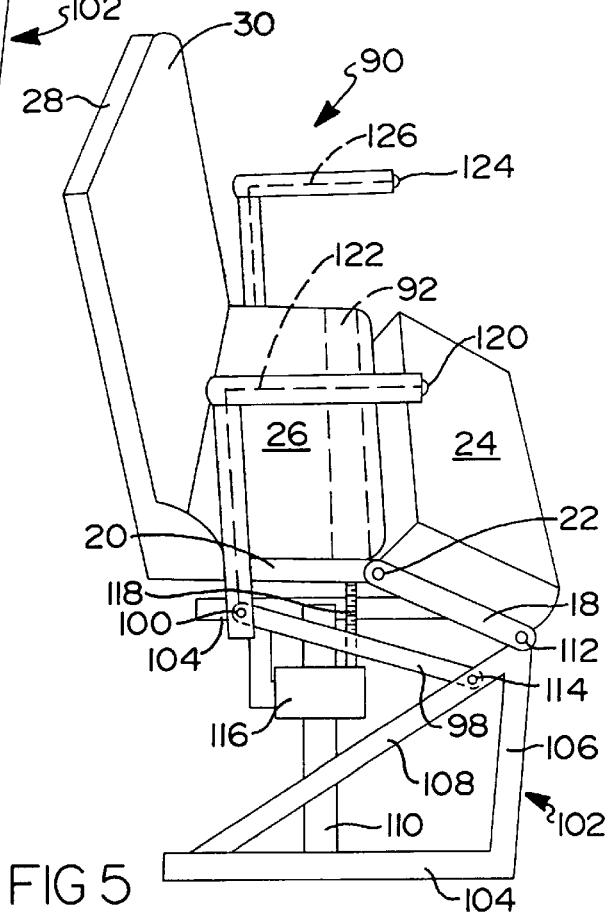
FIG. 5 is a perspective view of the elevator chair of FIG. 4 in a partially raised position.

Referring to FIGS. 4 and 5, a second embodiment of the elevator chair of the present invention indicated generally at 90 is shown, and structural elements of this chair which correspond to those shown in FIGS. 1–3 are identified by the same reference numeral. As in the case of the elevator chair 10, the elevator chair 90 includes a seat assembly 14 having a cushion supporting frame 16 which is formed into a front section 18 and a rear section 20. The front section of the cushion supporting frame is pivotally secured to the rear section by a hinge 22 which extends transversely across the frame. The front and rear sections of the cushion supporting frame are substantially rectangular sections with cross bars or a bottom wall to support a front section cushion 24 and a rear section cushion 26. One of these crossbars for the rear section 20 of the cushion supporting frame is shown in broken lines at 92 and is positioned adjacent the hinge 22.

In the elevator chair 90, arm rests 94 are supported by support bars 96 secured to the rear section 20 of the cushion supporting frame on opposite sides of the chair. The support bar 96 extends below the rear section 20 and mounts one end of an elongated link 98 at a pivotal attachment point 100. In FIGS. 4 and 5, the support linkage on one side of the chair is shown, but this structure is duplicated on the opposite side of the chair.

The elevator chair 90 is supported by a surface engaging support frame 102 which includes triangular supporting members on opposite sides of the chair, each of which has an elongate ground engaging leg 104 which extends in spaced relationship beneath the seat assembly 14 for substantially the extent of the seat assembly. Each triangular supporting member includes a forward support bar 106 extending upwardly from the forward end of the ground engaging leg 104 and an angled support bar 108 which angles from the top of the forward support bar 106 to the rear end of the ground engaging leg 104. A motor supporting crossbar 110 extends between the ground engaging legs 104 of the triangular supporting members on the opposite sides of the elevator chair 90.

The forward end of the front section 18 for the cushion supporting frame 16 is pivoted at 112 to the top of each triangular supporting member, and the forward end of the link 98 is pivoted to a triangular supporting member at a pivot point 114 spaced below the pivot 112.

Mounted on the motor supporting crossbar 110 is a reversible electric motor which is geared in known manner to drive a drive screw 118 that is connected to the crossbar 92 to both support and control movement of the elevator chair 90. Control buttons for the motor 116 are provided at the forward end of each of the chair arms 94 with a button 120 connected to the motor 116 by a circuit 122 to raise the chair and a button 124 connected to the motor by a circuit 126 to reverse the motor and lower the chair. The provision of the control buttons 120 and 124 at the forward ends of each arm of the elevator chair 90 is noteworthy, for these buttons allow the chair occupant to grasp both chair arms and to manipulate the chair throughout its range of movement without releasing the grip on either chair arm. This is extremely important for elderly and infirm occupants.

As will be noted from FIG. 5, activation of the control button 120 causes the motor 116 to extend the drive screw 118 to drive the seat assembly 14 upwardly. This causes the link 98 to pivot about the pivots 100 and 114, while the pivot 112 draws the front section 18 of the seat assembly downwardly about the pivot 22. It will be noted that the rear section of the seat assembly 20 and the back rest frame 28 maintain the same position as the seat rises that they maintained in FIG. 4 for a sitting position of the occupant. This allows the occupant to be fully supported in a sitting position as the front section 18 of the seat assembly drops and angles forward to bring the occupant's legs into a free standing support position. Then, as illustrated in FIG. 3, the chair 90 of FIG. 5 continues to rise until the back section 20 of the seat assembly and the back rest frame 28 are angled forwardly as shown in FIG. 3 due to the downward pull exerted by the pivot 112 on the front section 18 of the seat assembly and on the pivot 22 as the screw 118 drives the seat assembly further upwardly. Thus, once the occupant's legs are positioned to receive the occupant's weight in a free standing position, the rear section of the seat assembly tilts forward with the back frame 28 to aid in transferring the weight of the occupant from the chair to the occupant's legs.

I claim:

1. An elevator chair for raising an occupant above a chair support surface and facilitating the transfer of the occupant's weight from the chair to the occupant's legs comprising:

a support frame, a seat assembly mounted on said support frame including an occupant supporting seat having a rear seat section, a seat back connected to said rear seat section and extending upwardly therefrom, and a front seat section extending substantially across the extent of said rear seat section and having a first end pivotally connected thereto, and seat drive means mounted on said frame and connected to move said seat assembly upwardly relative to said frame from a first position where said front and rear seat sections extend in substantially the same first plane above said chair support surface to a second position spaced above said first position, said seat drive means maintaining said rear seat section in a plane substantially parallel to said first plane, said front seat section pivoting downwardly and angularly outwardly from said rear seat section as said seat assembly moves from said first position to said second position, said seat drive means operating further to raise said seat assembly from said second position to a third position where said rear seat section is tilted downwardly toward said support surface and said front seat section at an angle to said first plane.

2. The elevator chair of claim 1 wherein said front seat section includes a second end opposite to said first end and attachment means are provided to pivotally secure said second end to said support frame for pivotal movement relative to said support frame, said seat drive means moving said seat assembly upwardly to a second position where said rear seat section is spaced above said first position for a distance substantially equal to the distance between the first and second ends of said front seat section.

3. The elevator chair of claim 2 which includes first and second armrests secured respectively to opposite sides of said rear seat section, each said armrest extending above and in spaced relation to said seat assembly and terminating at a forward end above said front seat section, said seat drive means including a reversible electric motor for operation in a first direction or a second opposite direction mounted on said support frame and motor control means connected to said electric motor mounted on at least one of said armrests.

4. The elevator chair of claim 3 wherein said motor control means includes a first motor controller mounted on said first armrest to cause said electric motor to operate in said first direction and a second motor controller mounted on said second armrest to cause said electric motor to operate in said second direction.

5. The elevator chair of claim 4 wherein said first motor controller includes an actuator button mounted on the forward end of said first armrest and said second motor controller includes a second actuator button mounted on the forward end of said second armrest.

6. The elevator chair of claim 1 which includes at least one elongate link having a first end pivotally connected to said rear seat section and a second end opposite to said first end pivotally connected to said support frame.

7. The elevator chair of claim 6 wherein said seat drive means includes a reversible electric motor mounted on said support frame and means connecting said electric motor to drive said elongate link.

8. The elevator chair of claim 1 wherein said seat drive means includes a reversible electric motor for operation in a first direction or a second opposite direction mounted on said support frame and drive connector means extending between said electric motor and said rear seat section to raise or lower said seat assembly in response to operation of said electric motor.

9. The elevator chair of claim 8 wherein said front seat section includes a second end opposite to said first end and attachment means are provided to pivotally secure said second end to said support frame for pivotal movement relative to said support frame.

10. The elevator chair of claim 9 wherein said drive connector means includes a drive screw connected to be driven by said electric motor, said drive screw engaging said rear seat section.

11. The elevator chair of claim 10 which includes first and second armrests secured to said support frame on opposite sides of said seat assembly, each said armrest extending above and in spaced relationship to said seat assembly, said seat drive means including motor control means connected to said electric motor, said motor control means including a first motor controller mounted on said first armrest to cause said electric motor to operate in said first direction and a second motor controller mounted on said second armrest to cause said electric motor to operate in said second direction.

12. The elevator chair of claim 11 wherein said first and second armrests terminate at a forward end surface, said first motor controller including an actuator button mounted on the forward end surface of said first armrest and said second motor controller including an actuator button mounted on the forward end surface of said second armrest.

13. The elevator chair of claim 12 which includes at least one elongate link having a first end pivotally connected to said rear seat section and a second end opposite to said first end pivotally connected to said support frame.

14. The elevator chair of claim 9 which includes a first pivot connection between the first end of said front seat section and said rear seat section and a second pivot connection between the second end of said front seat section and said support frame, said second end of said front seat section being pivotally secured to said frame by said second pivot connection to permit said first end of said front seat section to move toward said second position and pivot about said first pivot connection as said seat assembly moves from said first to said second position, said front seat section being formed to prevent movement of said first pivot connection from said second position toward said third position as said electric motor and drive connector means operate to drive said rear seat section to said third position, said rear seat section pivoting about said first pivot connection as said rear seat section moves to said third position to tilt said rear seat section and said seat back.

15. The elevator chair of claim 14 wherein said drive connector means is pivotally connected to said rear seat section.

16. The elevator chair of claim 15 wherein said drive connector means includes at least first and second elongate links pivotally connected at a first end to said support frame and at a second end to said rear seat section, said first and second elongate links extending in substantially parallel spaced relationship on opposite sides of said support frame and rear seat section, and drive linkage means connected between said electric motor and at least one of said first and second elongate links.

17. The elevator chair of claim 16 which includes third and fourth elongate links extending in substantially parallel relationship to said first and second elongate links respectively, a first end of said third and fourth elongate links being pivotably connected to said support frame and a second end of said third and fourth elongate links being pivotally connected to said rear seat section.

18. The elevator chair of claim 14 which includes at least first and second elongate links pivotally connected at a first end to said support frame and at a second end to said rear seat section, said first and second elongate links extending in substantially parallel spaced relationship on opposite sides of said support frame and rear seat section.

19. The elevator chair of claim 18 wherein said drive connector means includes a drive screw connected to be driven by said electric motor.

20. The elevator chair of claim 14 wherein said seat assembly includes first and second armrests secured respectively to opposite sides of said rear seat section, each said armrest including an arm support extending above and in spaced relationship to said rear seat section and terminating at a forward end above said front seat section, said seat drive means including motor control means connected to said electric motor, said motor control means including a first motor controller mounted on said first armrest to cause said electric motor to operate in said first direction and a second motor controller mounted on said second armrest to cause said electric motor to operate in said second direction, said first motor controller including an actuator button mounted on the forward end of said arm support for said first armrest and said second motor controller including an actuator button mounted on the forward end of said arm support for said second armrest.

21. An elevator chair comprising:

a base frame assembly having a side frame member;

a seat assembly including a first rectangular seat section, a seat back extending upwardly from a back portion of said first rectangular seat section, and a second rectangular seat section pivotally coupled to said first seat section at a first hinge and pivotally coupled to said side frame member at a second hinge;

an elongated link having a first end pivotally coupled to said first seat section at a third hinge and a second end pivotally coupled to said side frame member at a fourth hinge; and a drive mechanism connected to said base frame assembly and operably coupled to said seat assembly for moving said seat assembly from a first position wherein said first seat section is substantially co-planar with said second seat section, through a second position wherein said first seat section is translated upwardly and forwardly from said first position such that said second seat section is angled downwardly with respect to said first seat section, to a third position wherein said first seat section is translated upwardly and forwardly and angled downwardly from said second position such that said second seat section is further angled downwardly with respect to said first seat section.

22. The elevator chair of claim 21 wherein the length of said second seat section as defined by the distance between said first hinge and said second hinge is less than the length of said elongated link as defined by the distance between said third hinge and said fourth hinge.

23. The elevator chair of claim 21 wherein said fourth hinge is located on said side frame member rearwardly and downwardly of said second hinge located on said side frame member.

24. The elevator chair of claim 23 wherein said side frame member is a triangular supporting member having a horizontal support bar, a vertical support bar and an angled support bar extending from an upper portion of said vertical support bar to a rearward portion of said horizontal support bar.

25. The elevator chair of claim 24 wherein said second hinge is located on said upper, forward portion of said side frame member and said fourth hinge is located on said angled support bar.

26. The elevator chair of claim 21 wherein said drive mechanism comprises a motor assembly pivotally coupled at a first end to said base frame assembly and operably connected to said first seat section at a second end.

27. The elevator chair of claim 21 wherein said drive mechanism comprises a motor assembly secured to said base frame assembly and a drive link having a first end connected to said motor assembly for rotation therewith and a second end operably coupled to said elongated link for moving said seat assembly.

28. The elevator chair of claim 21 further comprising a pair of armrests secured to opposite sides of said seat assembly such that said pair of armrests extend above and in spaced relation to said first seat section and terminate at a forward end above said second seat section.

29. The elevator chair of claim 28 further comprising a drive mechanism controller mounted on at least one of said pair of armrests and operably connected to said drive mechanism.

30. The elevator chair of claim 29 wherein said drive mechanism controller includes a first controller mounted on a first armrest to cause said drive mechanism to operate in a first direction and a second controller mounted on a second armrest to cause said drive mechanism to operate in said second direction.

31. The elevator chair of claim 30 wherein said first controller includes a first button mounted on said forward end of said first armrest and said second controller includes a second button mounted on said forward end of said second armrest.

32. An elevator chair comprising:

a base frame assembly having a side frame member;

a seat assembly including a first seat section having a substantially straight first edge, a seat back extending upwardly from a second edge of said first seat section, a second seat section pivotally coupled to said first seat section along said first edge at a first hinge, said second seat section pivotally coupled to said side frame member at a second hinge, and a pair of armrests secured to opposite sides of said seat assembly such that said pair of armrests extend above and in spaced relation to said first seat section and terminate at a forward end above said second seat section;

an elongated link having a first end pivotally coupled to said first seat section at a third hinge and a second end pivotally coupled to said side frame member at a fourth hinge; and a drive mechanism connected to said base frame assembly and operably coupled to said seat assembly for moving said seat assembly from a first position wherein said first seat section is substantially co-planar with said second seat section, through a second position wherein said first seat section is translated upwardly and forwardly from said first position such that said second seat section is angled downwardly with respect to said first seat section, to a third position wherein said first seat section is translated upwardly and forwardly and angled downwardly from said second position such that said second seat section is further angled downwardly with respect to said first seat section.

33. The elevator chair of claim 32 wherein the length of said second seat section as defined by the distance between said first hinge and said second hinge is less than the length of said elongated link as defined by the distance between said third hinge and said fourth hinge.

34. The elevator chair of claim 32 wherein said fourth hinge is located on said side frame member rearwardly and downwardly of said second hinge located on said side frame member.

35. The elevator chair of claim 34 wherein said side frame member is a triangular supporting member having a horizontal support bar, a vertical support bar and an angled support bar extending from an upper portion of said vertical support bar to a rearward portion of said horizontal support bar.

36. The elevator chair of claim 35 wherein said second hinge is located on said upper, forward portion of said side frame member and said fourth hinge is located on said angled support bar.

37. The elevator chair of claim 32 wherein said drive mechanism comprises a motor assembly pivotally coupled at a first end to said base frame assembly and operably connected to said first seat section at a second end.

38. The elevator chair of claim 32 wherein said drive mechanism comprises a motor assembly secured to said base frame assembly and a drive link having a first end connected to said motor assembly for rotation therewith and a second end operably coupled to said elongated link for moving said seat assembly.

39. The elevator chair of claim 38 further comprising a drive mechanism controller mounted on at least one of said pair of armrests and operably connected to said drive mechanism.

40. The elevator chair of claim 39 wherein said drive mechanism controller includes a first controller mounted on a first armrest to cause said drive mechanism to operate in a first direction and a second controller mounted on a second armrest to cause said drive mechanism to operate in said second direction.

41. The elevator chair of claim 40 wherein said first controller includes a first button mounted on said forward end of said first armrest and said second controller includes a second button mounted on said forward end of said second armrest.

* * * * *

UNITED STATES PATENT AND TRADEMARK OFFICE

CERTIFICATE OF CORRECTION

PATENT NO. : 5,984,411

DATED : November 16, 1999

INVENTOR(S) : Michael H. Galumbeck

It is certified that error appears in the above-identified patent and that said Letters Patent is hereby corrected as shown below:

On the Title Page under U.S. Patent Documents, Patent No. 5,096,008; Notice of References Cited attached to Office Action dated 9/15/97, reference "D"; "Mankoswski" should be -- Mankowski --.

On the Title Page under Foreign Patent Documents, reference 251508; Notice of References Cited attached to Office Action dated 9/15/97, reference "L"; "251508" should be -- 2515508 --.

On the Title Page under U.S. Patent Documents; Information Disclosure Citation attached to Notice of Allowability dated 8/28/98, Insert - (See attached Prior Art References initialed by the Examiner and not included -Form PTO-1449).

Signed and Sealed this

Twenty-second Day of August, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT : 5,984,411

DATED : Nov. 16, 1999

INVENTOR(S) : Michael Galumbeck

It is certified that error appears in the above-identified patent and that said Letters Patent is hereby corrected as shown below:

Title page, item [56] References Cited, U.S Patents and Foreign Documents
Insert the following:

| DOCUMENT NUMBER | | | | | | | DATE | NAME |
|---|---|---|---|---|---|---|---|---|
| 1 | 6 | 3 | 0 | 4 | 3 | 2 | 05/1927 | Hydom et al. |
| 2 | 6 | 9 | 0 | 7 | 9 | 1 | 10/1954 | Malco |
| 3 | 2 | 2 | 2 | 1 | 0 | 6 | 12/1965 | Stout |
| 3 | 2 | 5 | 0 | 5 | 6 | 9 | 05/1966 | Gaffney |
| 3 | 8 | 5 | 1 | 9 | 1 | 7 | 12/1974 | Horstmann et al. |
| 3 | 9 | 1 | 5 | 4 | 9 | 4 | 10/1975 | Somerset |
| 4 | 0 | 0 | 7 | 9 | 6 | 0 | 02/1977 | Gaffney |
| 4 | 5 | 8 | 1 | 7 | 7 | 8 | 04/1986 | Pontoppidan |
| 4 | 8 | 2 | 6 | 2 | 4 | 0 | 05/1989 | Karpiuk |
| 4 | 9 | 4 | 6 | 2 | 2 | 2 | 08/1990 | Matson |
| 5 | 3 | 1 | 2 | 1 | 5 | 3 | 05/1994 | Lin |
| 5 | 3 | 9 | 8 | 9 | 9 | 4 | 03/1995 | Thomas |
| 5 | 4 | 0 | 2 | 5 | 4 | 4 | 04/1995 | Crawford et al. |
| 5 | 5 | 8 | 4 | 0 | 8 | 2 | 12/1996 | Crawford et al. |
| 5 | 5 | 9 | 6 | 7 | 7 | 5 | 01/1997 | DiMatteo et al. |
| 5 | 6 | 0 | 9 | 3 | 4 | 8 | 03/1997 | Galumbeck |
| 5 | 6 | 6 | 6 | 6 | 7 | 3 | 09/1997 | Ammatelli et al. |
| 5 | 6 | 7 | 6 | 4 | 2 | 4 | 10/1997 | Winkelhake |

FOREIGN PATENT DOCUMENTS

| DOCUMENT NUMBER | | | | | | | DATE | COUNTRY |
|---|---|---|---|---|---|---|---|---|
| 0 | 0 | 7 | 7 | 2 | 8 | 0 | 09/1982 | EP |